United States Patent [19]

Pieper et al.

[11] 4,124,673

[45] Nov. 7, 1978

[54] PROCESS FOR THE PRODUCTION OF BIFILAR ACRYLIC FIBRES

[75] Inventors: Christian Pieper, Neuss; Karlheinz Feltgen; Alfred Nogaj, both of Dormagen, all of Germany

[73] Assignee: Bayer Aktiengesellschaft, Leverkusen, Germany

[21] Appl. No.: 768,852

[22] Filed: Feb. 15, 1977

Related U.S. Application Data

[63] Continuation of Ser. No. 669,696, Mar. 23, 1976, abandoned.

[30] Foreign Application Priority Data

Mar. 26, 1975 [DE] Fed. Rep. of Germany ..... 2513251

[51] Int. Cl.[2] ..... B29F 3/10

[52] U.S. Cl. ..... 264/171; 264/206

[58] Field of Search ..... 264/171, 168, 206; 428/373, 374

[56] References Cited

U.S. PATENT DOCUMENTS

| | | | |
|---|---|---|---|
| 3,266,093 | 8/1966 | Corbett | 264/171 |
| 3,701,819 | 10/1972 | Yoshida et al. | 264/171 |
| 3,780,149 | 12/1973 | Keuchel et al. | 264/171 |
| 3,904,730 | 9/1975 | Shimizu et al. | 264/171 |

FOREIGN PATENT DOCUMENTS

| | | | |
|---|---|---|---|
| 43-525 | 1/1968 | Japan | 264/171 |

*Primary Examiner*—Jay H. Woo

*Attorney, Agent, or Firm*—Plumley and Tyner

[57] ABSTRACT

The invention relates to a process for the production of bifilar fibres and filaments consisting of only one acrylonitrile polymer. The polymer is dissolved in a usual solvent and the resulting solution is divided up into two solution streams. After these solution streams have been brought to different temperatures they are spun by a conventional bifilar spinning technique.

12 Claims, No Drawings

PROCESS FOR THE PRODUCTION OF BIFILAR ACRYLIC FIBRES

This is a continuation, of application, Ser. No. 669,696, filed Mar. 23, 1976 now abandoned.

This invention relates to acrylic fibres and filaments with a permanent crimp, and to a process for their production by spinning two solutions of the same acrylonitrile polymer.

There are already numerous processes for the production and application of crimped acrylic fibres. Mechanically applied crimps generally have the disadvantage that they are not permanent. There are also processes for the conjugated spinning of two or more different materials to form bicomponent or multicomponent fibres in which the individual components are present in an eccentric arrangement relative to one another in the cross-section. In cases where acrylic fibres are used, the co-spun fibres have hitherto generally been produced from at least two solutions of at least two different polymers or polymer mixtures (German Auslegeschrift No. 1,494,677). Unfortunately, this procedure has the disadvantage not only that the polymers used have to be carefully selected, but also by the further disadvantage that two different solutions have to be prepared. In addition, it is known from German Auslegeschrift No. 1,210,123 that bifilar filaments can be produced by spinning two solutions of the same polymer, but with different concentrations, the differences in concentration being said to amount to at least 4% and preferably 10%. This process is still attended by the disadvantage that two different solutions have to be prepared for subsequent conjugate spinning.

It has now surprisingly been found that bifilar filaments with excellent crimping properties can be obtained by dividing up the solution of a polymer, heating the resulting two solutions to different temperatures and then spinning them against one another.

Accordingly, it is an object of the present invention to provide bicomponent fibres or filaments. It is a further object of this invention to provide fibres or filaments of only one polymer. Still another object of this invention is to provide fibres and filaments with a permanent water-resistant crimp from a single solution of that polymer. These and other objects which will be evident from the following description and the Examples are accomplished by a process for the production of bifilar fibres and filaments from an acrylonitrile polymer which comprises preparing a solution from that polymer in a conventional solvent, dividing up the resulting solution into two solution streams subjecting these two solution streams to a conventional bifilar spinning process at different temperatures.

The polymer used is generally a copolymer which contains at least 50% by weight of acrylonitrile and up to 50% by weight of one or more ethylenically unsaturated monomers copolymerisable with acrylonitrile or a mixture of two or more of the above-mentioned polymers. However, it is particularly preferred to use polymers which contain at least 85% by weight of acrylonitrile. Comonomers suitable for use in accordance with the invention are the comonomers known in this art of the type described, for example, in U.S. Pat. No. 3,035,031. Particularly preferred comonomers are acrylic acid or methacrylic acid esters for example, methylacrylate and ethylacrylate, vinyl esters, for example, vinylacetate, and comonomers which increase affinity for dyes, for example allyl and methyallyl sulphonic acid, styrene sulphonic acid and their salts.

The solutions may be dry or wet spun, preferably dry spun, by any of the known processes in such a way that substantially equal parts of the two components are present in the filament. In order to optimise the permanent crimp, it is best for the ratio of the polymer components in the filament to differ from 1:1, although it should not exceed a ratio of about 1:3.

The temperature difference between the two solution streams which is required for obtaining a particularly good crimp is of course governed by the physical and chemical properties of the polymer used, by the absolute level of the particular temperature selected and by the selected concentration of the solution. In order to determine this temperature difference, it is advisable to carry out a corresponding small-scale test in each individual case.

Temperature differences of about 30° C. have proved to be adequate. However, larger temperature differences, for example in the range from 40° to 120° C., are particularly preferred, the average absolute temperatures being of the order normally encountered in this art.

In principle, it is of course possible to divide up the solution stream and to establish the requisite temperature difference at any given point in front of the orifice of the spinneret. However, it is particularly favourable to carry out these measures as near to the orifice of the spinneret as possible because it is possible in this way to eliminate the need for a double pipe system for the solution stream.

One simple way of enhancing the crimp effect is to add small quantities of a solvent, preferably the spinning solvent, to one of the solution streams. In the context of the invention, small quantities of solvent are quantities which do not increase the difference in concentration between the solutions to beyond 4%. The solvents used are those well-known in the art of spinning acrylonitrile polymers. Preferably, dimethyl formamide, dimethyl acetamide, dimethyl sulphoxide and butyrolactone are used.

The two fibre components are spun by known methods in such a way that they are present in an eccentric arrangement to one another in the resulting bicomponent filament. This eccentric arrangement may be a core/cover arrangement, although it is preferably a side-by-side arrangement.

The bicomponent fibres are then after-treated by the methods normally adopted for acrylic fibres. Preferably the filaments are washed, stretched, optionally mechanically crimped, heat-treated, dried, and optionally cut into fibres.

Once it has been developed, the crimp is permanent and, for the fibres, represents the condition of minimal energy. It is also permanent and elastic when subjected to deformation. If the crimp is pulled out by mechanical deformation even to the point where the fibre breaks, it springs back into the fibre after a heat treatment.

The number of crimp arcs per unit length is governed by the composition of the polymer by the spinning conditions and by the type of aftertreatment. The crimp is a typical bifilar crimp, of the type also known from multicomponent fibres, i.e. it is inter alia helical. With numerous textiles, optimum appearance, good feel and high volume are obtained when the fibres contain from 4 to 12 crimp arcs per centimeter for a denier per filament of a 3.3 dtex.

The fibres are crimped by being subjected after stretching to a relaxing atmosphere at a higher temperature.

The invention is illustrated by the following Examples, in which parts and percentages are based on weight unless otherwise stated and which are to further illustrate the invention without limiting it.

EXAMPLE 1

An acrylonitrile copolymer of 93.6% of acrylonitrile, 5.7% of methacrylate and 0.7% of sodium methallyl sulphonate was dissolved in dimethyl formamide at 90° C. A solution with a polymer content of 29.5% was prepared. The solution was delivered to a bifilar spinneret. The solution stream was divided into two parts. One of the two solution streams (A) was heated to 130° C. and the other (B) cooled to 40° C. The solutions had a ball drop time of 24 seconds (A) and 300 seconds (B). (The ball-drop time is a measure of solution viscosity. It is the time which a ball with a diameter of ⅛ th inch △ 3.175 mm takes to travel a distance of 7 cm in the solution at the temperature indicated).

The solutions were introduced into a bifilar spinneret in a ratio of A to B of 1.2:1 and were spun side-by-side. Several bifilar spinnerets were arranged on a die base and air which had been heated to 380° C. flowed past the base. The filaments were run off at a rate of 300 m/minute. The duct situated below the spinneret had a wall temperature of 170° C. After spinning, the spun material was washed with water for 30 seconds at 100° C. The material was then stretched 1:4 in water at 100° C. The filaments were then dried for 2 minutes at 100° C. in the absence of tension. The resulting crimp in the filaments was intensified by boiling the filaments for 10 minutes in water, followed by tempering for 20 minutes at 130° C. The fibres had a denier of 3.3 dtex and contained 4 crimp arcs per centimeter. The number of crimp arcs per centimeter is derived from the quotient of the number of crimp arcs and the length of the fibre from which the crimp has been just pulled out by elongation.

Spinning and aftertreatment under the same conditions as above, but with the stretching ratio altered to 1:2.5, produced a fibre with a denier of 5.8 dtex and 10 crimps per centimeter.

EXAMPLE 2

A solution in dimethyl formamide with a polymer content of 31% was prepared from an acrylonitrile polymer with the same chemical composition as described in Example 1. The solution stream was divided into two component streams A and B on its way to the bifilar spinneret. DMF was introduced into component stream B before a static mixer in such a quantity that, after the static mixer, solution B had a uniform polymer content at 27%. Solution stream A was then heated to 130° C. whilst solution stream B was cooled to 40° C. Solution A had a ball drop time of 440 seconds and solution B a ball drop time of 13 seconds. The solutions were spun against one another under the same conditions as in Example 1 in a ratio of A to B of 1.3:1. The filaments thus obtained were aftertreated in the same way as in Example 1. They contained 9 crimp arcs per centimeter for a stretching ratio of 1:2.5 and 7 crimp arcs per centimeter for a stretching ratio of 1:4.

EXAMPLE 3

Following the procedure of Examples 1 and 2, solutions were prepared from the same polymer. As in the preceding Examples, these solutions were divided and spun against one another with and without additions of DMF. The filaments were aftertreated in the same way as described in Example 1. Table 1 shows the concentrations of the solution streams, the solution temperatures, the quantitative ratio between the solutions, the solution viscosities and the number of crimp arcs per cm for the material which was stretched in ratiosof 2.5 and 1:4.

EXAMPLE 4

An acrylonitrile polymer mixture was prepared from two polymers *x* and *y*, of which polymer *x* had been completely polymerised from acrylonitrile and polymer *y* from 91% of acrylonitrile, 3.4% of sodium methallyl sulphonate and 5.6% of methylacrylate. The polymers *x* and *y* were present in the mixture in a ratio of 85:15. This mixture was dissolved in dimethyl formamide at 90° C. A solution with a polymer content of 25.5% was prepared. The solution was delivered to a bifilar spinneret. The solution stream was divided into two component streams A and B. The component streams were heated to different temperatures and were introduced in different quantities into the bifilar spinneret. The spinning and aftertreatment conditions for the filaments were the same as in Example 1. Table 2 shows the temperatures, the quantative ratios and viscosities of the solution streams and the number of crimp arcs per centimeter for stretching ratios of 1:2.5 and 1:4.

The invention is by no means limited to the above Examples and test conditions, so that special modifications would not exceed the scope of the invention.

Table 1

| Polymer content of the solutions | | Temperatures of the solutions before entering the spinneret | | Ratio of solutions | | Ball drop times (in seconds) | | Crimp arcs per cm after stretching | |
|---|---|---|---|---|---|---|---|---|---|
| A | B | A | B | A | B | A | B | 1 : 2,5 | 1 : 4 |
| 29,5% | 29,5% | 130° C | 40° C | 1,2 | : 1 | 24 | 300 | 10 | 4 |
| 31% | 27% | 40° C | 130° C | 1,3 | : 1 | 440 | 13 | 9 | 7 |
| 29,5% | 29,5% | 130° C | 40° C | 1 | : 1,62 | 24 | 300 | 7 | 4 |
| 29,5% | 24,3% | 130° C | 80° C | 1 | : 1,21 | 24 | 36 | 7 | 3 |
| 29,5% | 24,3% | 130° C | 130° C | 1 | : 1 | 24 | 8,5 | 4 | 2 |
| 31% | 27% | 40° C | 130° C | 1,04 | : 1 | 440 | 13 | 10 | 5 |
| 31% | 27% | 40° C | 130° C | 1 | : 1 | 440 | 13 | 9 | 5 |

Table 2

| Temperatures of the solutions | | Ratio of Solutions | | Ball drop times (in seconds) | | Crimp arcs per cm after stretching | |
|---|---|---|---|---|---|---|---|
| A | B | A | B | A | B | 1 : 2,5 | 1 : 4 |
| 130° C | 70° C | 1 | : 1 | 26 | 130 | 5 | 11 |
| 130° C | 130° C | 1 | : 1,2 | 26 | 26 | — | — |
| 130° C | 100° C | 1 | : 1,2 | 26 | 35 | — | 1 |
| 130° C | 70° C | 1 | : 1,2 | 26 | 130 | 2 | 9 |

What we claim is:

1. A process for the production of bifilar fibres and filaments from an acrylonitrile polymer which comprises preparing a solution from that polymer in a solvent selected from the group consisting of dimethyl formamide, dimethyl acetamide, dimethyl sulfoxide and butyrolactone, and dividing up the resulting solution into two solution streams, subjecting both of these two solution streams to a conventional bifilar spinning process at different temperatures to form a bicomponent fiber.

2. The proess of claim 1 in which the temperatures differ from about 30° to 120° C.

3. The process of claim 1, wherein said polymer of acrylonitrile is a copolymer of at leat 50% by weight of acrylonitrile and up to 50% by weight of at least one ethylenically unsaturated monomer copolymerisable with acrylonitrile.

4. The process of claim 3, wherein said copolymer contains at least 85% by weight of acrylonitrile.

5. The process of claim 3, wherein said copolymer contains at least one comonomer from the group comprising methylacrylate, vinylacetate, sodium methallyl sulphonate, and sodium styrene sulphonate.

6. The process of claim 1, wherein said solution streams are introduced into the spinneret in different quantities.

7. The process of claim 1, wherein a small quantity of additional solvent is added to one of said solution streams.

8. The process of claim 1, wherein said spinning process is a dry-spinning process.

9. The process of claim 1, wherein a molecular orientation is imparted to the filaments of fibres by stretching.

10. The process of claim 1, wherein said two solution streams are spun in a side-by-side arrangement.

11. The process of claim 1, wherein said two solution streams are spun in a core/cover arrangement.

12. A process for the production of bifilar fibres and filaments from an acrylonitrile polymer which comprises preparing a solution from that polymer in a solvent selected from the group consisting of dimethyl formamide, dimethyl acetamide, dimethyl sulfoxide and butyrolactone, and dividing up the resulting solution into two solution streams, adjusting the temperature of said stream to a difference of 30°–140° C., as close to the orifice of bifilar spinneret as possible and subjecting both of these two solution streams to a conventional bifilar spinning process at said different temperatures to form a bicomponent fiber.

* * * * *